US005291621A

United States Patent [19]

Mathis

[11] Patent Number: 5,291,621

[45] Date of Patent: Mar. 8, 1994

[54] SPA JET ASSEMBLY

[76] Inventor: Cleo D. Mathis, 16209 Santa Bianca, Hacienda Heights, Calif. 91745

[21] Appl. No.: 820,414

[22] Filed: Jan. 15, 1992

[51] Int. Cl.[5] ..... A61H 33/02; B05B 1/30

[52] U.S. Cl. ..... 4/541.4; 4/541.6; 239/414; 239/579

[58] Field of Search ..... 4/492, 541.1, 541.3, 4/541.4, 541.5, 541.6; 239/251, 262, 414, 428.5, 579; 251/352

[56] References Cited

U.S. PATENT DOCUMENTS

| | | | |
|---|---|---|---|
| 2,462,989 | 3/1949 | Mufich et al. | 251/352 |
| 3,473,736 | 10/1969 | Heitzman | 239/101 |
| 3,890,655 | 6/1975 | Mathis | 4/541.6 |
| 3,940,066 | 2/1976 | Hunter | 239/579 X |
| 4,101,075 | 7/1978 | Heitzman | 239/101 |
| 4,264,039 | 4/1981 | Moreland | 239/428.5 |
| 4,416,030 | 11/1983 | Reynoso | 4/541.6 |
| 4,508,665 | 4/1985 | Spinnett | 4/541.6 X |
| 4,530,467 | 7/1985 | Bueno | 239/407 |
| 4,542,854 | 9/1985 | Mathis | 4/541.6 X |
| 4,671,463 | 6/1987 | Moreland et al. | 4/541.6 X |
| 4,715,071 | 12/1987 | Henkin et al. | 4/541.6 |
| 4,731,887 | 3/1988 | Henkin et al. | 4/541.6 |
| 4,982,459 | 1/1991 | Henkin et al. | 4/541.6 X |
| 5,014,372 | 5/1991 | Thrasher et al. | 4/541.6 |

*Primary Examiner*—William A. Cuchlinski, Jr.
*Assistant Examiner*—John L. Beres
*Attorney, Agent, or Firm*—Cushman, Darby & Cushman

[57] ABSTRACT

A spa jet assembly includes an orifice, a coverhead and a rotor mounted within the orifice and the coverhead. The orifice includes an axial port for water to enter into the spa jet assembly. The orifice also includes a radial port to allow air to enter into the spa jet assembly. The rotor is rotated by the flow of air and water through the spa jet assembly. The exiting air and water mixture from the spa jet assembly creates a pulsation effect. In a second embodiment, an orifice is rotatably connected to a control cylinder. A jet head is rotatably connected to the control cylinder about a pin shaft that is fixed at a common longitudinal axis to the orifice. The jet head is movable axially to a limited extent with respect to the control cylinder. The jet head can rotate freely with respect to the control cylinder in a first axial position. The jet head rotates with the control cylinder by an amount less than 360° in the second position to vary the fluid flow rate in the apparatus. A cross-sectional opening of an air inlet and a water inlet are both simultaneously varied so that the identical proportions of water and air are maintained in the jet spa assembly in the various flow rates.

12 Claims, 7 Drawing Sheets

SPA JET ASSEMBLY

BACKGROUND OF THE INVENTION

1. Field of the Invention

The present invention relates to a spa jet and, in particular, to a spa jet which is self rotating and can easily control the flow rate through the spa jet.

2. Background Information

Most spa jets are typically made to be adjustable both in the direction in which the water is discharged and in the rate of flow of the water. However, most techniques have proven to be unsatisfactory to some degree based on the complex mechanisms that have previously been required to produce a spa jet.

For example, U.S. Pat. No. 5,014,372 issued to Thrasher et al discloses a rather complex spa jet that can independently control the speed of rotation and the flow rate. To accomplish this, a brake washer 68 is installed adjacent to the nozzle rotor 50 and a compression spring 70 applies a controllable breaking force to the rotor to control its rotationable speed. This complex mechanism includes a detent arm 72 that is integrally connected to a retainer cage 52. The detent arm 72 engages with a series of concave depressions 76 formed on the inside surface of the sleeve 48 to vary the speed of rotation of the rotor 50. If the detent arm 72 were to break off from the retainer 52, then the bather could easily inadvertently disassemble the entire spa jet assembly.

U.S. Pat. No. 4,508,665 issued to Spinnett discloses a cross bar that is positioned in front of the rotor to intermittently block the fluid exiting the rotor to thereby create a pulsation effect.

It will be appreciated from the foregoing that there is still a need for a spa jet assembly with water driven rotational capability that is built as a one piece assembly and is maintenance free. The present invention meets this requirement and has the advantage that, in one embodiment, the flow rate may still be varied.

SUMMARY OF THE INVENTION

It is an object of the present invention to provide a spa jet that is of a simple one piece construction.

It is a further object of the present invention to provide a spa jet of simple construction by which the user can simultaneously, easily vary the fluid flow rate and speed of rotation of the jet head.

A further object is to provide the spa jet assembly of the present invention such that it is easy to install in an apparatus having existing plumbing and fixtures using conventional spa jets. The present invention, therefore, provides a simple and inexpensive method for rapidly converting each of the conventional spa jets to a spa jet as taught by the present invention.

A further object is to construct a spa jet that can not be easily removed by a bather.

Other objects, features and characteristics of the present invention, as well as the methods of operation and functions of the related elements of the structure, and the combination of parts and economies of manufacture, will become more apparent upon consideration of the following detailed description and the appended claims with reference to the accompanying drawings all of which form a part of this specification, wherein like reference numerals designate corresponding parts in the various figures.

DETAILED DESCRIPTION OF THE PRESENTLY PREFERRED EXEMPLARY EMBODIMENTS

Figure 1:
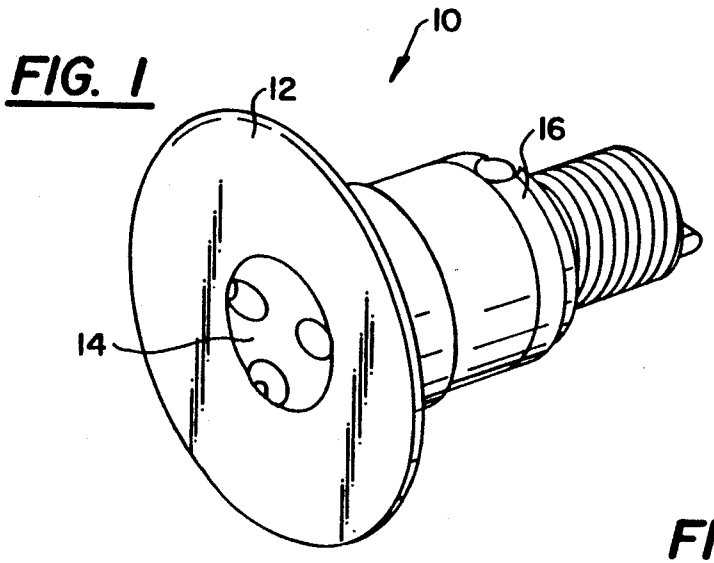
FIG. 1 is a perspective view of a spa jet assembly according to the first embodiment of the present invention.
Figure 2:
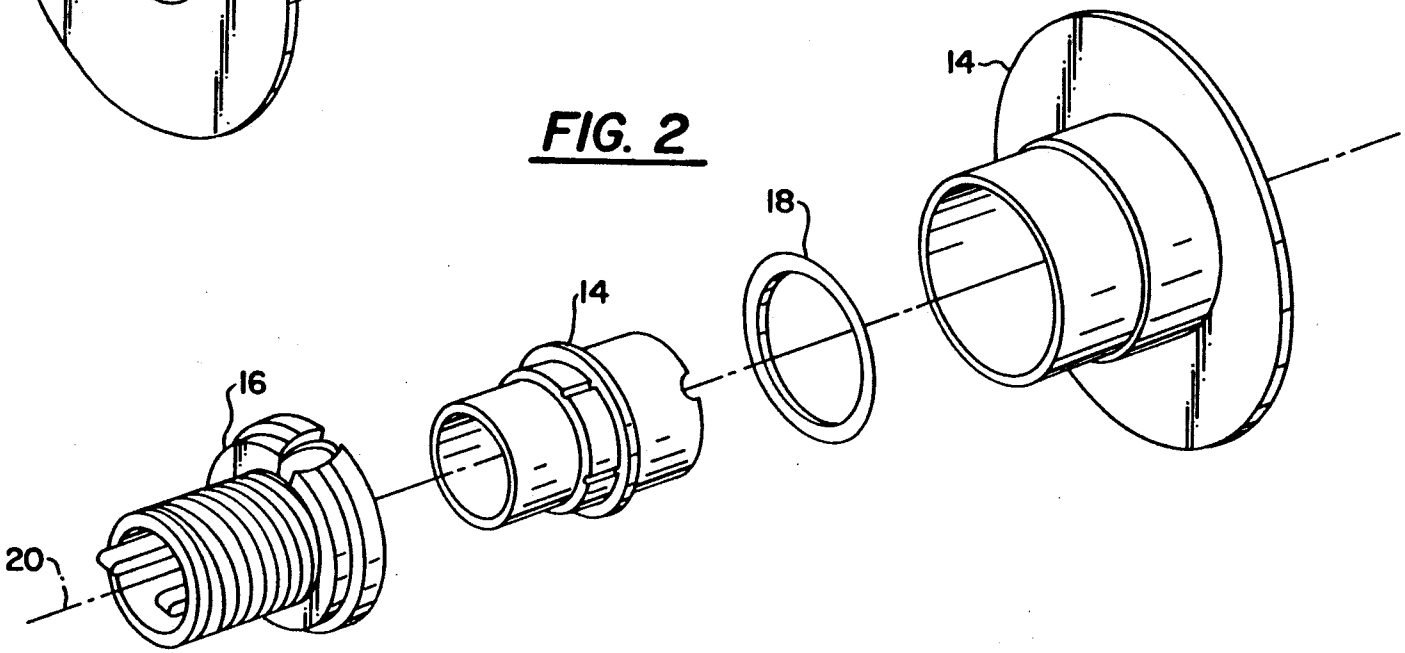
FIG. 2 is an exploded view of the spa jet assembly according to the first embodiment of the present invention.

A spa jet formed with a small rotary eyeball is shown by way of example, in FIG. 2. The assembly 10 includes a coverhead 12, a rotor or eyeball 14 and an orifice 16.

The spa jet is shown in an exploded view in FIG. 2 with the coverhead 12, a retaining ring 18, the rotor 14 and the orifice 16 being mounted along a common longitudinal axis 20.

Figure 4:
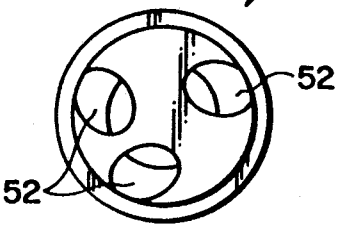
FIG. 4 is a front view of the rotor.
Figure 3:
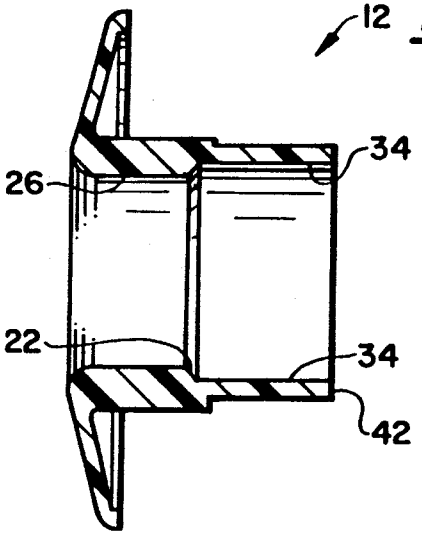
FIG. 3 is a cross-sectional view of the coverhead.
Figure 5:
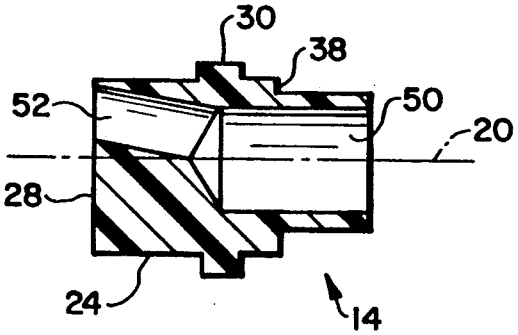
FIG. 5 is a cross-sectional view of the rotor.

A cross-sectional view of the coverhead 12 is shown in FIG. 3. An annular bevelled surface 22 receives the retaining ring 18 in the assembled positioned. Rotor 14 can best be seen in FIGS. 4 and 5. A front outer cylindrical portion 24 of the rotor 14 is received within the front inner cylindrical portion 26 of the coverhead 12 so that the front axial surface 28 of the rotor 14 is substantially flush with the front surface of the coverhead. The ring shaped projection 30 on the rotor 14 abuts against the retaining ring 18 within the coverhead 12.

Figure 10:
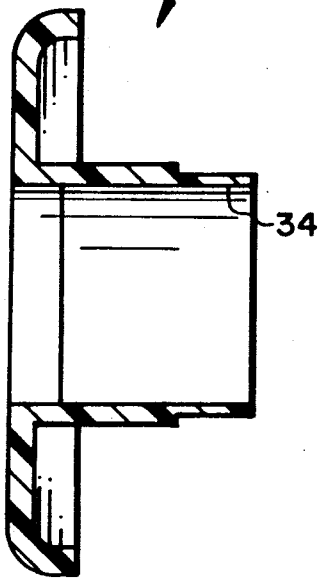
FIG. 10 shows a cross-sectional view of an alternate embodiment of the coverhead.

An alternate embodiment of the coverhead 12 is shown in FIG. 10. This embodiment is used so the spa jet can be fitted in conventional spa jets of different size.

Figure 7:
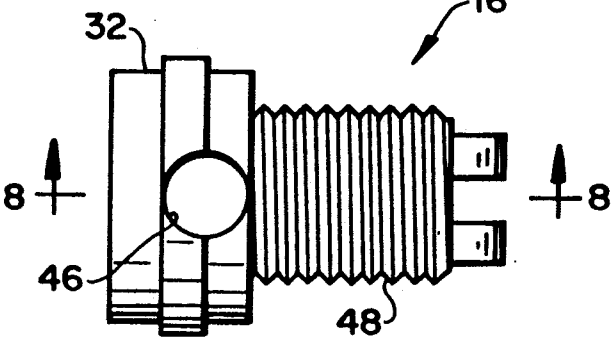
FIG. 7 is a side view of the orifice.
Figure 6:
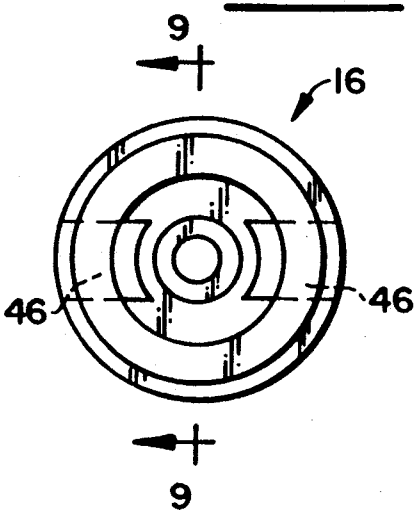
FIG. 6 is a front view of the orifice.
Figure 9:
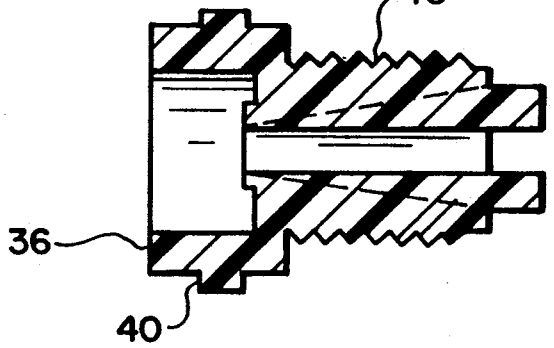
FIG. 9 is a cross-sectional view taken along line B—B of FIG. 6.
Figure 8:
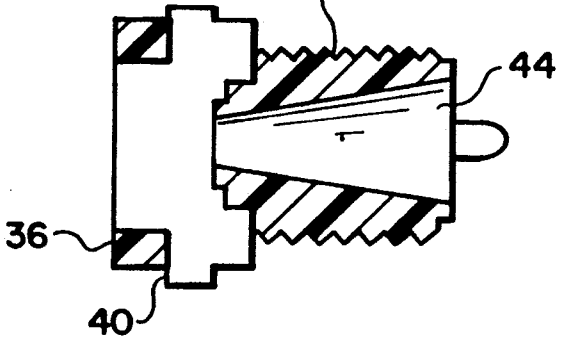
FIG. 8 is a cross-sectional view taken along line A—A of FIG. 7.

The orifice can best be seen in FIGS. 6-9. A front outer cylindrical portion 32 of the orifice 16, as shown in FIG. 7, is received within the rear internal cylindrical surface 34 of the coverhead 12 in the assembled position. A front annular surface 36 of the orifice 16 mates with a rear annular surface 38 on the rotor 14 to provide a rear axial thrust bearing for the rotor.

A front annular surface 40 on the orifice 16 mates with a rear annular surface 42 on the coverhead 12 to encase the rotor 14 within the assembly. The coverhead 12 and the orifice 16 are fixedly connected to one another to form the spa jet assembly as a one piece construction. The coverhead 12 and the orifice 16 can be fixedly connected by, for example, chemical bonding.

The orifice 16 includes a rear axial opening 44 to allow water to enter the spa jet assembly. The orifice 16 also has two diametrically opposed passages 46 to allow air to enter the spa jet assembly. The rear external cylindrical portion of the assembly also includes a male threaded connection 48 so that the spa jet can easily be connected to an existing plumbing fixture.

During use, water enters the rear opening 44 of the spa jet assembly and entrains air through passages 46 into the flow path. The air and water mixture then enters a rear opening 50 of the rotor 14. The air water mixture then enters the three passages 52 in the front portion of the rotor assembly and exits the spa jet assembly. The force from the fluid flow as it impinges against the angled passages 52 impart a rotational force on the rotor 14. The rotor 14 thereby rotates to create a pulsating effect in the bath (not shown). The passages 52 are inclined with respect to the longitudinal axis 20 and to the direction of fluid flow to impart the rotational force from the fluid as it flows through the rotor 14.

FIGS. 11-26 show the spa jet of the second embodiment of the present invention. The spa jet assembly 100 includes a jet head 102, a control cylinder 104, an orifice 106, a pin shaft 108 and a pair of pop rivets 110. An O-ring 111 is placed between the rear axial surface 124 of the control cylinder 104 and a forward facing rear axial surface 132 of the orifice 106. A seal ring 114 is placed along the outer cylindrical surface of the orifice 106, at shoulder 116, to seal the spa jet assembly 100 against the wall of a bath (not shown).

The orifice is shown is FIGS. 13-17. Orifice 106 includes an axial rear end surface 112 that has an opening 114 for water to enter the spa jet assembly. Rear axial surface 112 of the orifice 106 also includes a circular opening 116 for the pin shaft 108 and pop rivet 110. The pin shaft 108 is fixed to the orifice 106 by the pop rivet 110.

Figure 17:
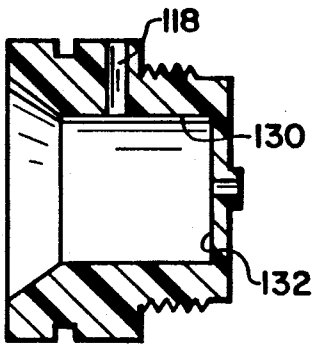
FIG. 17 is a cross-sectional view of the orifice taken along line 17—17 of FIG. 13.
Figure 13:
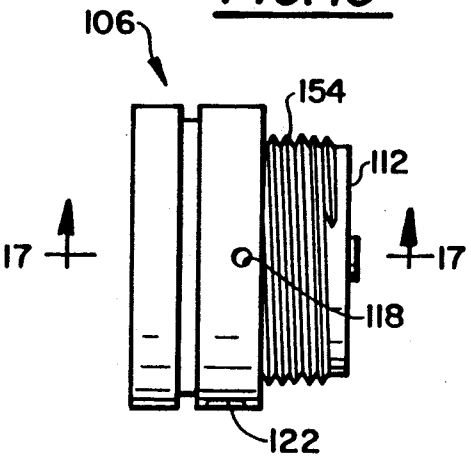
FIG. 13 is a side view of the orifice according to the second embodiment of the present invention.
Figure 16:
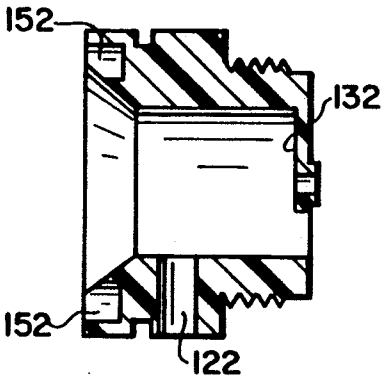
FIG. 16 is a cross-sectional view of the orifice taken along line 16—16 of FIG. 15.

There are two radial passages through the cylindrical wall portion of the orifice 106. The first passage 118 is shown in FIGS. 13 and 17. The passage 118 is formed to receive a guide pin (not shown) that fits within a corresponding groove 120 in the control cylinder 104. See FIGS. 18, 20 and 23. A second radial passage 122 through the orifice 106 is shown in FIGS. 13 and 16. The radial passage 122 is an air inlet into the spa jet assembly.

The control cylinder 104 is shown in greater detail in FIGS. 18-23. The control cylinder includes a rear axial surface 124 that includes an opening 126. See FIG. 19. The outer cylindrical surface 128 of the control cylinder 104 fits snugly within the inner cylindrical surface 130 of the orifice 106. In the assembled position, the rear axial surface 124 of the control cylinder mates with a rear inner axial surface 132 of the orifice 106. The O-ring 111 prevents water from travelling around the outer cylindrical surface of the control cylinder 104.

The control cylinder is rotatably mounted within the orifice 106. By rotating the control cylinder 104 with respect to the orifice 106, the opening 126 of the control cylinder 104 can be alternately aligned with the opening 114 of the orifice 106 to allow water to enter into the spa jet assembly. The control cylinder can be rotated to vary the opening into the spa jet assembly between being fully opened, or 100%, to being fully closed, or 0%. In an alternate embodiment, the size of the opening in the control cylinder can be varied between being fully opened, or 100%, and being only partially opened or at approximately 20%.

Figure 14:
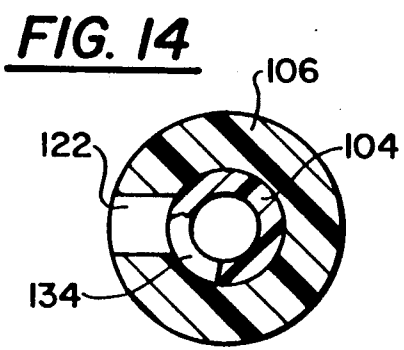
FIG. 14 is a cross-sectional view of the orifice and control cylinder taken along line 14—14 of FIG. 11.
Figure 11:
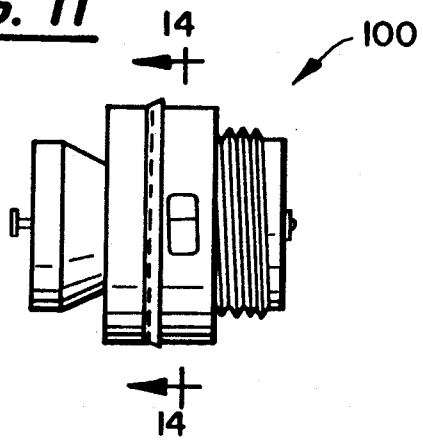
FIG. 11 is a side view of a spa jet assembly according to a second embodiment of the present invention.
Figure 22:
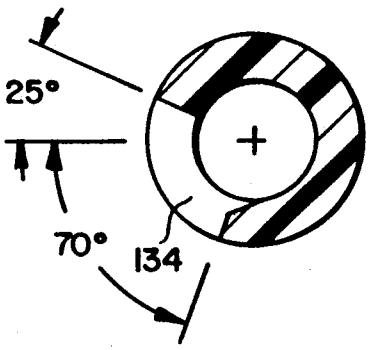
FIG. 22 is a cross-sectional view of the flow control cylinder taken along line D—D of FIG. 21.
Figure 23:
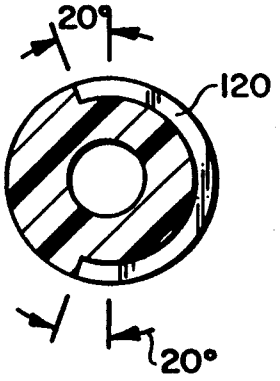
FIG. 23 is a cross-sectional view of the flow control cylinder taken along line C—C of FIG. 18.
Figure 19:
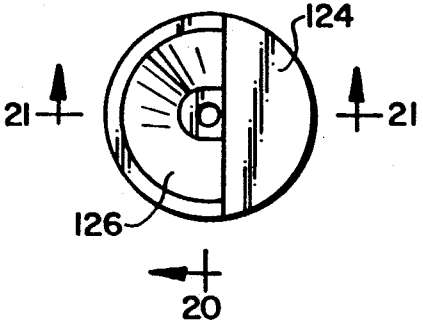
FIG. 19 is a rear end view of the flow control cylinder.
Figure 21:
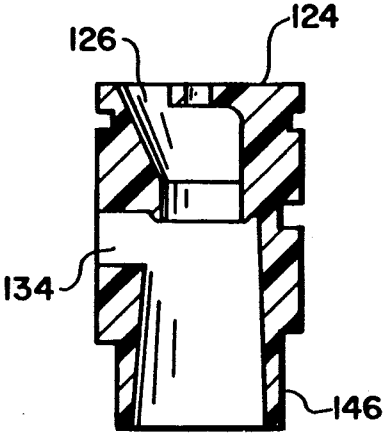
FIG. 21 is a cross-sectional view of the flow control cylinder taken along line A—A of FIG. 19.
Figure 18:
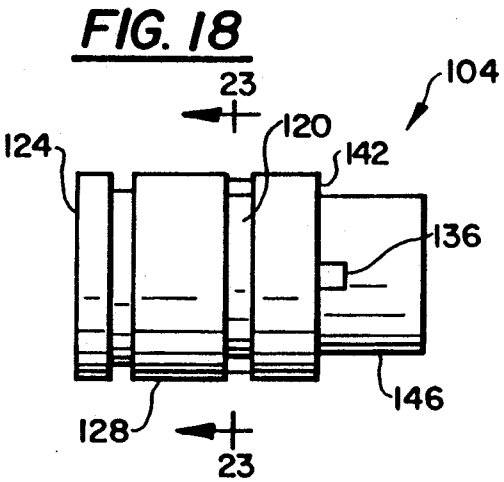
FIG. 18 is a side view of the flow control cylinder according to the second embodiment of the present invention.
Figure 20:
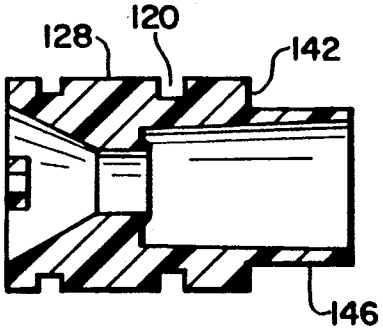
FIG. 20 is a cross-sectional view of the flow control cylinder taken along line B—B of FIG. 19.
Figure 24:
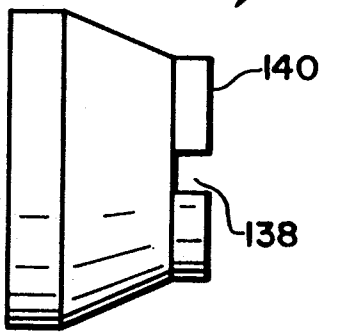
FIG. 24 is a side view of the jet head according to the second embodiment of the present invention.
Figure 26:
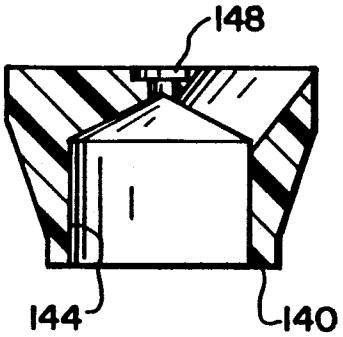
FIG. 26 is a cross-sectional view of the jet head taken along line 26—26 of FIG. 25.
Figure 25:
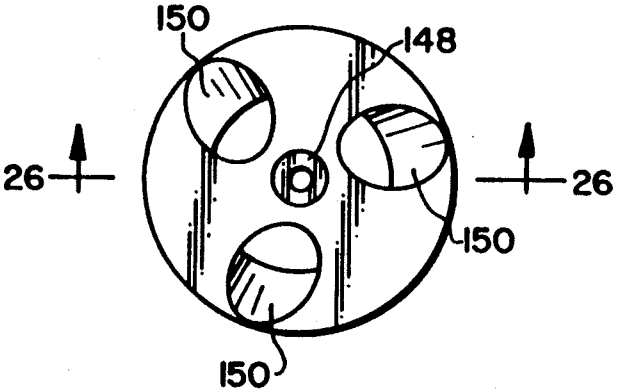
FIG. 25 is a front view of the jet head according to the second embodiment of the present invention.

A radial opening 134 in the control cylinder 104 can be seen in FIGS. 21 and 22. The radial opening 134 aligns with the radial opening 122 in the orifice to allow air to enter into the spa jet assembly. As the control cylinder 104 is rotated with respect to the orifice, the opening for the air inlet is varied simultaneously with the opening for the water inlet. Therefore, the percentage of the water and air entering into the spa jet assembly is simultaneously controlled to the same degree. FIG. 14 shows the radial opening 122 in the orifice 106 partially aligned with the opening 134 in the control cylinder 104 at an intermediate position between fully opened and fully closed.

The control cylinder 104 also includes a pair of diametrically opposed projections 136 that mate with a pair of diametrically opposed recesses 138 in the jet head 102. The jet head 102 is shown in greater detail in FIGS. 24-26. The jet head 102 includes an annular rear axial surface 140 that faces a forward annular shoulder 142 on the control cylinder 104. An inner cylindrical surface 144 of the jet head 140 is axially slidably received over the outer cylindrical surface 146 of the control cylinder 104. The jet head 102 is axially movable with respect to the control cylinder 104 to a limited degree. The jet head rear axial surface 140 is shown abutting the annular surface 142 of the control cylinder 104 in FIG. 11.

A pop rivet 110 is fixed within an axial opening 148 of the jet head 102. The pop rivet 110 allows the jet head to freely rotate about the pin shaft 108. The jet head 102 includes three passages 150 through the front axial wall of the jet head to allow the water and air mixture to exit the jet spa apparatus. The passages 150 are angled so that the water and air mixture imparts a rotational force on the jet head 102.

During operation, water and air separately enter the jet spa assembly. The force from the water and air mixture imparts a rotational force on the jet head and also impart an axial force on the jet head in the forward direction. Therefore, the jet head 102 is moved to its furthermost left position. In this position, the projections 136 on the control cylinder disengage with the recesses 138 in the jet head and the jet head freely rotates about the pin shaft axis 108.

To adjust the flow rate through the jet spa assembly, the bather simply grasps the jet head and pushes in the axial rearward direction (into the jet spa assembly) and turns the jet head until the recesses 138 in the jet head 102 align with the projections 136 in the control cylinder 104. The jet head will then axially move in the rearward direction so that the recesses 138 in the jet head 102 engage with the projections 136 in the control cylinder 104. Thereafter the jet head 102 and control cylinder 104 can be manually rotated together by the bather to simultaneously adjust the cross-sectional openings for the water inlet and the air inlet to vary the openings between 0% and 100% in one embodiment or between 20% and 100% in a second embodiment.

When the desired flow rate is obtained, the bather simply releases the jet head 102 and the water and air mixture will again force the jet head to its forward most position and the jet head will resume freely rotating about the pin shaft axis 108. By varying the flow rate the bather can experience a pulsation from the fluid flow when the flow rate is near 100% to a swirling effect at lower flow rates. Of course, the bather could adjust the flow rate when no fluid is passing through the jet spa assembly if desired.

Figure 12:
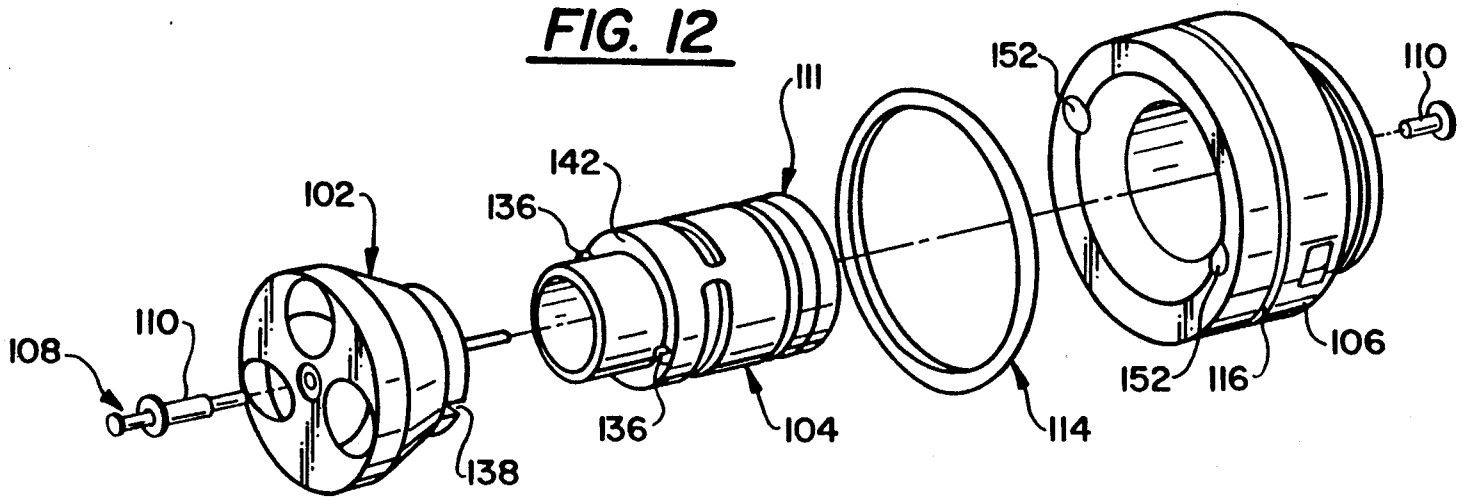
FIG. 12 is an exploded view of the spa jet assembly according to the second embodiment of the present invention.
Figure 15:
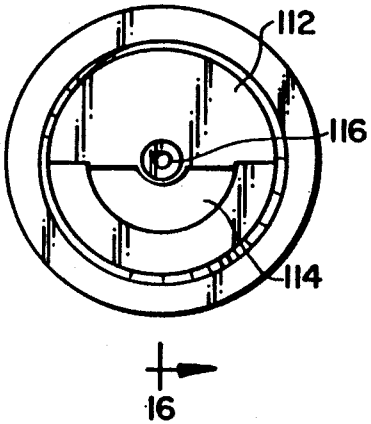
FIG. 15 is a rear end view of the orifice according to the second embodiment of the present invention.

The orifice also includes two diametrically opposed indentations 152, as shown in FIGS. 12 and 16. The rear external cylindrical surface of the orifice includes a male thread 154 so that the jet spa assembly can be easily connected to existing plumbing. The two diametrically opposed recesses 152 are designed so that a special tool is required to be inserted into these recesses to screw the jet spa assembly into conventional plumbing. Therefore, a bather cannot inadvertently remove the jet spa assembly.

While the invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. An apparatus comprising:

(a) an orifice;

(b) a coverhead fixed to said orifice;

(c) a rotor rotatably mounted within said orifice and said coverhead, said orifice, said coverhead and said rotor being substantially mounted along a common longitudinal axis;

(d) said orifice having a first means for allowing water to enter said apparatus, said first means including a port on the axial end of said orifice opposite to said coverhead, said orifice having a second means for allowing air to enter said apparatus, said second means includes at least two radial ports located diametrically opposite to each other;

(e) said rotor having a third means for allowing a water and air mixture to exit said apparatus, said third means having at least three conduits arranged substantially symmetrically about said longitudinal axis, said at least three conduits each having an axis being inclined with respect to said longitudinal axis to impart a rotational force on said rotor when fluid is being passed through said apparatus; and (f) means for preventing fluid flow around an outer periphery of said rotor, wherein said fluid flow prevention means includes an O-ring.

2. An apparatus comprising;

(a) an orifice;

(b) a control cylinder being rotatably connected to said orifice;

(c) a jet head being rotatably connected to said control cylinder;

(d) a pin shaft being fixed to said orifice at a common longitudinal axis of said orifice, said control cylinder and said jet head; and (e) said jet head having a means for allowing a limited axial movement of said jet head with respect to said control cylinder in a first axial position to a second axial position, said jet head being rotatably mounted with respect to said control cylinder in said first position, said jet head and said control cylinder being rotatably mounted with respect to said orifice in said second position to vary a fluid flow rate through said apparatus.

3. An apparatus according to claim 2, wherein said orifice includes a first means for allowing water to enter said apparatus, said orifice having a second means for allowing air to enter said apparatus.

4. An apparatus according to claim 3, wherein said jet head includes a third means for allowing a water and air mixture to exit said apparatus, said third means having at least three conduits arranged substantially symmetrical about said longitudinal axis, said at least three conduits each having an axis being inclined with respect to said longitudinal axis to impart a rotational force on said jet head when fluid is being passed through said apparatus.

5. An apparatus according to claim 4, wherein said first means includes a port on the axial side of said orifice opposite to said jet head.

6. An apparatus according to claim 5, wherein said second means includes a radial port.

7. An apparatus according to claim 3, wherein when said jet head is in said second position, said control cylinder being rotated by said jet head to vary a cross-sectional opening of the first and second means, said control cylinder being rotated by an angle less than 360°.

8. An apparatus according to claim 7, wherein the cross-sectional opening of the first and second means is varied between being fully opened and being fully closed.

9. An apparatus according to claim 7, wherein the cross-sectional opening of the first and second means is varied between being fully opened and being partially open at approximately 20%.

10. An apparatus comprising:

(a) an orifice having a first means for allowing water to enter said apparatus, said orifice having a second means for allowing air to enter said apparatus, wherein said second means includes a radial port;

(b) a control cylinder being rotatably connected to said orifice;

(c) a jet head being rotatably connected to said control cylinder, said jet head including a third means for allowing a water and air mixture to exit said apparatus, said third means having at least three conduits arranged substantially symmetrical about said longitudinal axis, said at least three conduits each having an axis being inclined with respect to said longitudinal axis to impart a rotational force on said jet head when fluid is being passed through said apparatus;

(d) said orifice, said control cylinder, and said jet head having a common longitudinal axis and said first means including a port on the axial side of said orifice opposite to said jet head; and (e) said jet head having a means for allowing a limited axial movement of said jet head with respect to said control cylinder in a first axial position to a second axial position, said jet head being rotatably mounted with respect to said control cylinder in said first position, said jet head and said control cylinder being rotatably mounted with respect to said orifice in said second position to vary a fluid flow rate through said apparatus, said jet head, when in said second position, said control cylinder being rotated by said jet head to vary a cross-sectional opening of the first and second means, said control cylinder being rotated by an angle less than 360°.

11. An apparatus according to claim 10, wherein the cross-sectional opening of the first and second means is varied between being fully opened and being fully closed.

12. An apparatus according to claim 10, wherein the cross-sectional opening of the first and second means is varied between being fully opened and being partially open at approximately 20%.

* * * * *